United States Patent [19]

Duchemin

[11] 4,088,267

[45] May 9, 1978

[54] ELASTICALLY YIELDABLE RAIL FASTENER AND RAIL FIXING DEVICE INCLUDING SAID FASTENER

[75] Inventor: Michel Duchemin, Lambres les Douai, France

[73] Assignee: Ressorts du Nord S.A., Paris, France

[21] Appl. No.: 744,771

[22] Filed: Nov. 24, 1976

[30] Foreign Application Priority Data

Nov. 26, 1975 France ..... 75 36208

[51] Int. Cl.[2] ..... E01B 9/30; E01B 9/48

[52] U.S. Cl. ..... 238/349; 238/338

[58] Field of Search ..... 238/349, 338, 310, 315, 238/372

[56] References Cited

U.S. PATENT DOCUMENTS

| | | | |
|---|---|---|---|
| 1,453,507 | 5/1923 | Kimball | 238/349 X |
| 2,251,196 | 7/1941 | Muller | 238/349 |
| 3,164,323 | 1/1965 | Steele et al. | 238/349 |
| 3,888,414 | 6/1975 | Duchemin | 238/349 |

FOREIGN PATENT DOCUMENTS

| | | | |
|---|---|---|---|
| 846,119 | 9/1939 | France | 238/349 |
| 1,261,993 | 4/1961 | France | 238/349 |

*Primary Examiner*—Drayton E. Hoffman
*Assistant Examiner*—Randolph A. Reese
*Attorney, Agent, or Firm*—Burns, Doane, Swecker & Mathis

[57] ABSTRACT

The elastically yieldable fastener comprises an elastically yieldable strip bent onto itself and forming two superimposed branches. A clamping device extends through apertures in the two branches for clamping the strip to the support of the rail. The upper branch has a boss disposed between the aperture of the upper branch and the free end of the latter and between lateral portions of the upper branch which are adapted to bear against the lower branch when the strip is clamped by the clamping device. The clamping device defines a lower surface for contacting the upper surface of the boss and the two surfaces have the same shape so that, in the normally clamped position of the strip, the portion of the branch carrying the surface contacting the clamping device is raised with respect to the lateral portions.

8 Claims, 5 Drawing Figures

ELASTICALLY YIELDABLE RAIL FASTENER AND RAIL FIXING DEVICE INCLUDING SAID FASTENER

The present invention relates to elastically yieldable fasteners which fasten rails to their support and are constituted by a spring strip through which extend clamping means which clamp the strip on the rail flange and on the support.

The elasticity of these fasteners must permit the interposition of an elastic sole member or pad between the rail and the support, ensure that the clamping means are not hammered by the vertical up-and-down movements of the rail and ensure a substantially constant clamping of the rail. Such fasteners are therefore characterized by their flexibility and their efficiency.

The flexibility of the fastener is usually termed the vertical displacement of the rail, per unit variation in the clamping force, from the normal clamping position. There are therefore a downward flexibility and an upward flexibility which are different.

The "efficiency" of the fastener is the ratio between the rail clamping force and the force exerted by the clamping means on the fastener. As the force exerted by the clamping means is mostly limited by its anchorage in the support of the rail, only an increase in the efficiency enables the clamping of the rail to be improved.

Generally, the fastener may be considered as a lever to which three forces are applied, namely: the resultant of the forces clamping the rail flange, the force exerted by the clamping means on the fastener and the reaction on the support of the rail. Consequently, the efficiency is equal to the ratio between the distances between the reaction on the support of the rail and respectively the resultant of the forces clamping the rail flange and the clamping force of the fastener.

The obtainment of an optimum efficiency therefore presupposes a positioning of the clamping means as near as possible to the flange of the rail and/or an elongation of the fastener, the alignment of the clamping force of the fastener and the resultant of the clamping forces on the flange ensuring an efficiency equal to 1.

Now, the flexibility of fasteners formed by a substantially flat spring strip, such as those usually employed at the present time, is a function of the length of the branch bearing on the rail flange, which necessitates moving the clamping means away from this flange.

Various means have been envisaged for improving the flexibility of these fasteners, but none has been found to be completely compatible with the obtainment of a satisfactory efficiency. The most flexible fasteners are those in which the strip is bent onto itself and has two superimposed branches interconnected by a loop portion which is adapted to bear on the support of the rail, the lower branch coming in contact with the rail flange whereas the upper branch receives the clamping force of the clamping means. In the normal clamping position, the two branches are applied against each other, but tend to resume their initial spacing, which imparts to the fastener great flexibility, particularly in the downward direction.

In practice, this flexibility has been found to be excessive and the efficiency too low. It will be understood that it is possible to reduce the flexibility by shortening the branches of the strip so as to decrease the angle of spacing between the branches. Moreover, this moves the clamping means toward the rail flange, but above all this moves the point of bearing of the loop portion on the support toward the rail flange so that the efficiency is reduced and the rail clamping force is not increased.

An object of the present invention is to overcome these drawbacks and to provide a strip which has two branches which are interconnected by a loop portion and are each provided with an aperture for the passage of clamping means and has both an improved flexibility and a good efficiency.

According to the invention there is provided a strip which comprises on its upper branch, between the aperture for the passage of the clamping means and its free end and between two lateral portions for bearing on the lower branch, a boss whose upper surface has a shape corresponding to the shape of the clamping means, whereby, in the normal clamping position, the portion of the branch carrying the surface of contact with the clamping means is raised with respect to the lateral portions for bearing on the lower branch.

Preferably, the boss is produced by a press-forming operation of the upper branch. Moreover, its central portion has a slight outwardly-facing concavity.

The strip thus provides the clamping means an important bearing surface adjacent the flange of the rail which moves the bearing point of the clamping force away from the axis of the clamping means and moves it nearer to the resultant of the rail clamping forces, irrespective of the vertical displacement effected by the rail. The efficiency is consequently sufficiently improved to permit the shortening of the branches required to reduce the flexibility to the optimum value and obtain, however, a marked improvement in the rail clamping force.

According to a preferred embodiment, the coaxial apertures for the passage of the clamping means formed in the two branches extend, in the upper branch, in a part of the boss and, in the lower branch, in the inclined part for forming the loop portion.

The clamping means is therefore located practically against the rail flange so that the dissymmetrical clamping of the clamping means results in an efficiency of the order of 0.8 to 1.

It must be understood that the invention is also applicable to a device for fixing a rail by means of an elastically yieldable fastener formed by a bent strip comprising two branches interconnected by a loop portion through which branches there extend clamping means which apply them against each other and clamp the lower branch against the rail flange and the loop portion against the support, wherein the upper branch of the fastener has, between the aperture for the passage of the clamping means and its free end, a boss which projects in the direction of the clamping means and is defined laterally by two tabs for bearing on the lower branch and has a shape corresponding to the shape of the clamping means, whereby the clamping means are in continuous contact with a part of the branch which is offset in height with respect to the lateral bearing tabs and exert on the fastener a dissymmetrical clamping force which is essentially concentrated on the part of the fastener bearing on the rail, irrespective of the displacement of the rail flange.

The ensuing description with reference to the accompanying drawings, given solely by way of example, will explain the advantages and the operation of the fasteners according to the invention.

Figure 1:
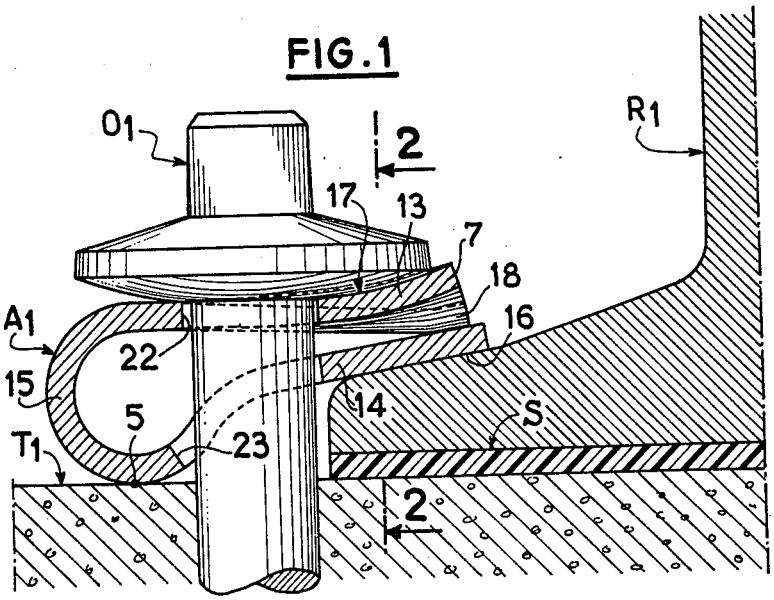
FIG. 1 is a partial sectional view of a rail-fastening arrangement comprising a fastener according to the present invention.

As shown in FIG. 1, a rail $R_1$ placed on its support, such as a sleeper or tie $T_1$, for example with interposition of an elastically yieldable sole member or pad S, is clamped by a fastener according to the invention by the effect of clamping means $O_1$ which are constituted in the illustrated embodiment by a coach-screw which has a shank and a head portion which acts on a flexible strip $A_1$.

The strip $A_1$ (FIG. 3) has an upper branch 13 connected to a lower branch 14 by a bent or loop portion 15 which bears against the sleeper $T_1$. The lower branch 14 has a planar surface 16 which bears against the flange of the rail $R_1$. The upper branch 13 has a bowed shape clearly shown in FIG. 2. The branch 13 has an upper open-ended boss 7 whose height increases in the direction of the free end of the branch between two lateral portions or tabs 18, 19 which are located on opposite sides of an intermediate portion of the branch 13 and adapted to contact the lower branch in use of the fastener as shown in FIG. 1. The open end of the boss 7 is at the free end of the branch 13. The upper surface of the boss 7 defines a region 17 in which the clamping means $O_1$ bear and has a shape complementary to the shape of the latter. In the illustrated preferred embodiment, the clamping means $O_1$ are in the form of a coach-screw whose head has a curved convex lower surface of revolution about the shant of the screen and the bearing region 17 has an outwardly-facing concavity of corresponding shape and is connected to the tabs 18 and 19 by two curved portions 8 and 9 (FIG. 2), the concavity of which portions faces in the opposite direction. The boss 7 is preferably formed by a press-forming operation on the upper branch 13 so that on the opposite surface of this branch a hollow is formed which is bordered laterally by the tabs 18 and 19. The two branches are each provided with an aperture 22, 23 for the passage of the shank of the clamping means $O_1$. The aperture 22 of the upper branch 13 is provided at the start of the boss 7 which is thus located therebetween and the free end of this branch, whereas the aperture 23 is provided at the junction between the curved portion 15 and the rectilinear portion 16 of the branch 14.

Figure 3:
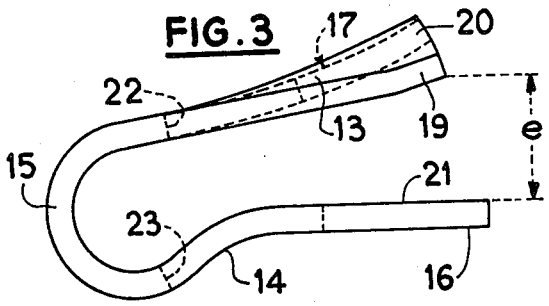
FIG. 3 is a view of the fastener shown in FIG. 1 in the free state.

In the free state, the strip $A_1$ has the shape shown in FIG. 3, the branches 13 and 14 being spaced apart a distance *e* at their free ends and interconnected by the loop portion 15 at the opposite ends.

Figure 2:
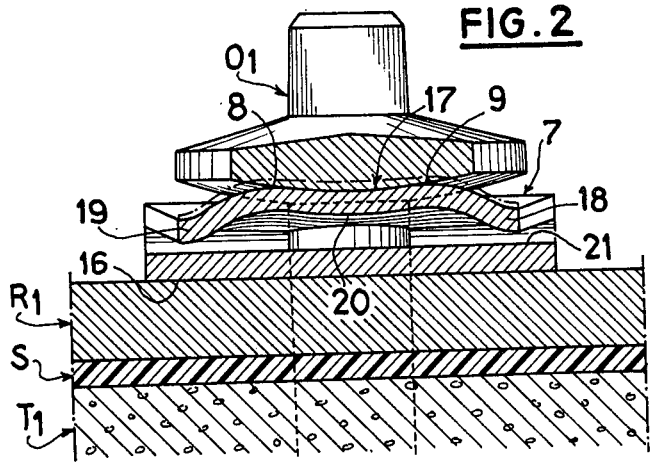
FIG. 2 is a cross-sectional view taken on line 2—2 of the fastener shown in FIG. 1.

When the clamping means $O_1$ are tightened, they bear on the region 17 of the upper branch 13, the surface 16 of the lower branch 14 bearing on the flange of the rail $R_1$. The loop portion 15 bears on the sleeper $T_1$ and the branch 13 moves towards the lower branch 14. The clamping means are tightened until the tabs 18, 19 abut the upper surface 21 of the lower branch 14, the lower surface 20 of the region 17 remaining at a certain distance from this surface 21 (FIG. 2).

The correct clamping is achieved without any other control or checking, the distance *e* of the two branches having been pre-determined to produce the suitable clamping force of the rail $R_1$.

The downward flexibility is ensured by the movement of the lower branch 14 whose surface 16 follows the movement of the rail flange.

Its upward flexibility results from the partial crushing of the boss 7 which results in a certain moving together of the surfaces 20 and 21.

As shown in FIG. 1, the strip $A_1$ is extremely short, the loop portion 15 is practically under the head of the coach-screw $O_1$ and the latter is very close to the flange of the rail $R_1$. The upward and downward flexibilities are therefore reduced to the desired optimum value.

Moreover, the coach-screw bears by its lower spherical dome-shaped surface against the spherical dome-shaped bearing surface 17 in the part of the branch 14 which is between the aperture 22 and the free end, that is to say in the part located above the flange of the rail. On the other side of the aperture 22, the branch 14 does not have a boss and moreover tends to extend in a direction away from the coach-screw to form the curved portion 15. The major part of the clamping force exerted by the clamping means $O_1$ on the strip $A_1$ is thus transferred to the boss 7 toward the flange of the rail $R_1$ and consequently in the direction of the resultant of the forces clamping the flange. It is true that the point 5 at which the loop portion 15 bears on the sleeper is relatively close to the flange of the rail, but it will be observed that the reduction in the distance between the force clamping the fastener and the resultant of the forces clamping the flange has a greater effect than a reduction in the length of the fastener and that, consequently, the efficiency of this fastener is in the neighborhood of 1 (between 0.8 and 1). Moreover, it is substantially constant, since the rail remains continuously bearing against the relatively short surface 16, whereas the clamping means bear against the same region 17 of short length. Moreover, any possible displacement of the two forces occurs in the same direction.

In some cases, it is necessary to prevent the lateral displacement of the rail which is subjected to oblique thrusts. This is achieved with a fastener modified in accordance with the strip $A_2$ shown in FIG. 4 which is mounted on a support or sleeper $T_2$ having a shoulder 24. The strip $A_2$ differs from the fastener $A_1$ in respect of the shape of the lower branch whose bent or loop portion 25 is adapted to the shape of the shoulder 24 and has a cranked portion or heel 26 adapted to bear against the edge 27 of the flange of a rail $R_2$.

In order to ensure good efficiency of this fastener, it is of interest to arrange that the clamping means be as near as possible to the edge 27 of the flange of the rail. For this reason, the aperture 28 of the lower branch of the strip is extended to 29 in the heel portion 26 to the start of the rectilinear portion 16.

Figure 5:
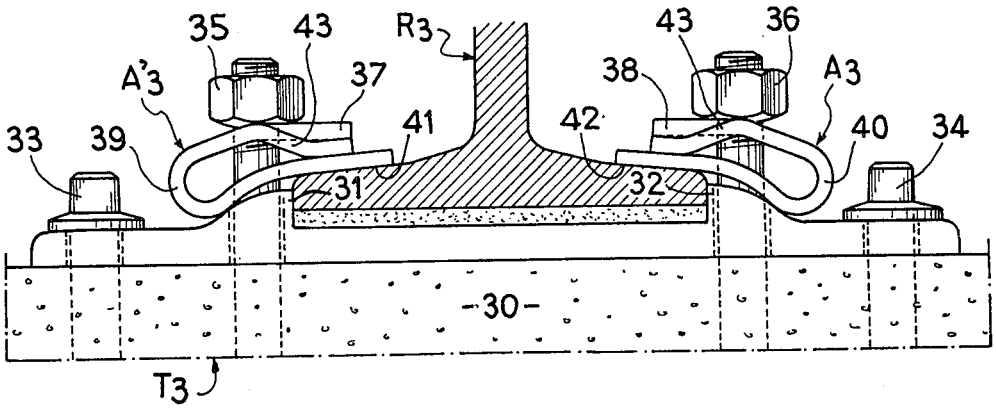
FIG. 5 is an elevational view of a rail fixing device according to another modification of the invention.

Another means, known per se, for preventing the lateral displacement of the rail comprises, as shown in FIG. 5, fixing on a support $T_3$ of the rail a sole member 30 constituted by a plate having guides 31, 32 between which the flange of a rail $R_3$ is maintained laterally. The member 30 is fixed to the support $T_3$ of the rail by coach-screws 33, 34. The rail $R_3$ is fixed to the sole member 30 by elastically yieldable fasteners comprising strips $A_3$, $A'_3$ which are clamped by clamping means 35 and 36 anchored in the support $T_3$ of the rail or in the sole member 30. The shape of the strips $A_3$ and $A'_3$ is similar to that of the strip $A_1$. They each comprise on their upper branch 43 a boss 37, 38 defining a support or bearing surface of a shape corresponding to the shape of the head of the clamping means, a bent or loop portion 39, 40 whose shape and dimensions are determined by the desired flexibility, and a lower branch 41, 42 which bears on the sole member 30 and the flange of the rail $R_3$.

Figure 4:
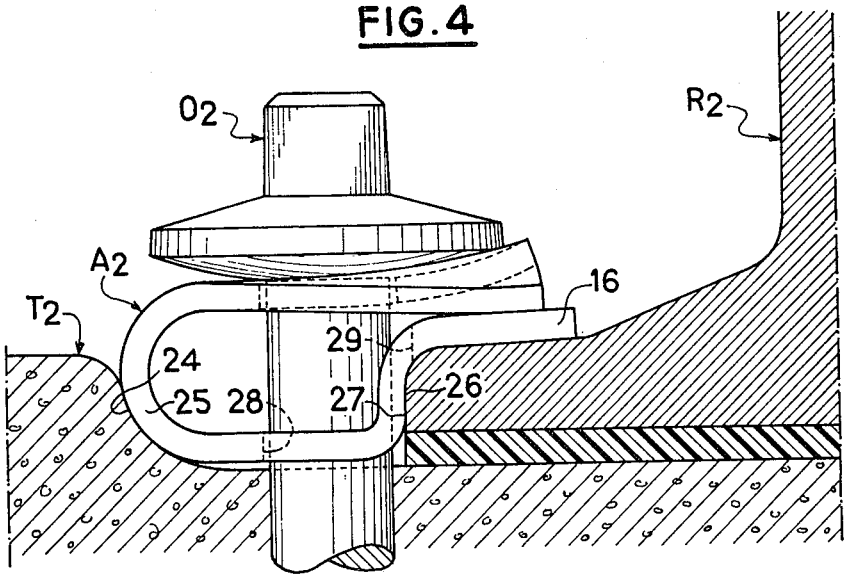
FIG. 4 is similar to FIG. 1 of a modification of the fastener.

As with the fixing devices shown in FIGS. 1 and 4, the clamping means exert on the strip a dissymmetrical force and clamp the part of the strip which is located above the flange of the railmore, so that the efficiency is considerably improved with respect to conventional fasteners in which the clamping force is exerted on the axis of the clamping means. Moreover, as in the foregoing embodiments, this force is maintained irrespective of the position of the flange of the rail, owing to the large surface of contact between the boss and the clamping means and to the fact that this surface is not modified by the vertical displacements of the rail.

The invention is not intended to be limited to the embodiments which have been given by way of examples. It is applicable to the fixing of rails on any rail support whether it be of wood, concrete or metal, each fastener being clamped by a bolt, coach-screw, screw or some other clamping means, with, if desired, a sole member interposed between the rail and its support.

Having now described my invention what I claim as new and desire to secure by Letters Patent is:

1. An elastically yieldable fastener for fastening a rail to a support for the rail, comprising in combination an elastically yieldable strip bent onto itself and including two branches of substantially the same length disposed one above the other and a curved portion interconnecting the branches, the branches extending longitudinally from said curved portion to free ends of the branches and each branch defining an aperture, and clamping means having a shank extending through the apertures and upper means defining a lower surface, an upper branch of said branches having substantially the same thickness throughout the upper branch and comprising an intermediate portion longitudinally extending from said curved portion to said free end of the upper branch and two lateral portions which are located on opposite sides of said intermediate portion and extend longitudinally of the upper branch substantially from a plane containing centers of said apertures to said free end of the upper branch and extend downwardly toward the lower branch of said branches from said intermediate portion and define with said intermediate portion an open-ended boss which is arch-shaped in transverse planes of the upper branch and has the open end adjacent said free end of the upper branch, the lateral portions each having an end portion which is adjacent said free end of the upper branch and is solely capable of contacting the lower branch when said clamping means clamp the strip and urge the two branches toward each other in use of the fastener, the branches being further apart from each other and said end portions being out of contact with the lower branch when the strip is in a free state and unclamped by the clamping means, the boss defining an upper surface which is located in said intermediate portion and is for contact with said lower surface of the clamping means and has a shape which is complementary to the shape of said lower surface in a region of said lower surface extending longitudinally of the upper branch substantially from said plane toward said free end of the upper branch substantially to an outermost edge of said lower surface when said end portions of the lateral portions are in contact with the lower branch, said intermediate portion of the upper branch being in spaced relation to the lower branch when said end portions of the lateral portions are in contact with the lower branch.

2. A fastener as claimed in claim 1, wherein the boss has an outwardly facing concavity in a center part thereof for engaging said lower surface of the clamping means.

3. A fastener as claimed in claim 2, wherein the cavity has the shape of a portion of a spherical dome centered with respect to the aperture of the upper branch and the lower surface of the clamping means is of revolution about the shank.

4. A fastener as claimed in claim 1, wherein the boss is produced by a press-forming of the strip and is therefore defined by a wall of the strip which is deformed throughout the thickness of the wall of the strip and which also defines a hollow on an opposite surface of the upper branch.

5. A fastener as claimed in claim 1, wherein the lateral portions extend substantially from a side of the aperture of the upper branch remote from said free end of the upper branch.

6. A fastener as claimed in claim 1, wherein the lower branch defines a cranked portion for abutment against the flange of the rail and the aperture of the lower branch extends into said cranked portion.

7. A structure comprising a rail having a flange, a rail support, an elastically yieldable pad interposed between the flange of the rail and the support and an elastically yieldable fastener disposed on each side of the rail flange for fastening the rail to the support, each fastener comprising in combination an elastically yieldable strip bent onto itself and including two branches of substantially the same length disposed one above the other and a curved portion interconnecting the branches and in bearing relation to the support, the branches extending transversely of the rail from said curved portion to free ends of the branches and each branch defining an aperture, and clamping means having a shank extending through the apertures and anchored to the support and upper means defining a lower surface, a lower branch of said branches being in bearing relation to the flange of the rail adjacent said free end of the lower branch, the upper branch of said branches having substantially the same thickness throughout the upper branch and comprising an intermediate portion extending transversely of the rail from said curved portion to said free end of the upper branch and two lateral portions which are located on opposite sides of said intermediate portion and extend transversely of the rail substantially from a plane containing centers of said apertures to said free end of the upper branch and extend downwardly toward the lower branch of said branches from said intermediate portion and define with said intermediate portion an open-ended boss which is arch-shaped in vertical planes parallel to the rail and has an open end adjacent said free end of the upper branch, the lateral portions each having an end portion which is adjacent said free end of the upper branch and is solely capable of contacting the lower branch when said clamping means clamp the strip and urge the two branches toward each other irrespective of the vertical position of the rail relative to the support in use of the fastener, the branches being further apart from each other and said end portions being out of contact with the lower branch when the strip is in a free state and unclamped by the clamping means, the boss defining an upper surface which is located in said intermediate portion and is in contact with said lower surface of the clamping means and has a shape which is complementary to the shape of said lower surface in a region of said lower surface extending transversely of the rail substantially from said plane substantially to an outermost edge of said lower surface adjacent said rail when said end portions of the lateral portions are in contact with the lower branch, said intermediate portion of the upper branch being in spaced relation to the lower branch when said end portions of the lateral portions are in contact with the lower branch.

8. A structure as claimed in claim 7, wherein said upper surface of the boss is concave and substantially in the shape of a portion of a dome centered on the aperture of the upper branch.

* * * * *